United States Patent [19]

Dorrell

[11] 4,336,150

[45] Jun. 22, 1982

[54] LUBRICANT

[75] Inventor: Peter M. Dorrell, Nr Northwich, England

[73] Assignee: Steetley Minerals Limited, Nottinghamshire, England

[21] Appl. No.: 166,601

[22] Filed: Jul. 7, 1980

[30] Foreign Application Priority Data

Jul. 9, 1979 [GB] United Kingdom ..... 7923898

[51] Int. Cl.[3] ..... C10M 1/24; C10M 1/26

[52] U.S. Cl. ..... 252/56 R; 252/12; 252/12.2; 252/56 S

[58] Field of Search ..... 252/12, 12.2, 12.4, 252/12.6, 56 R, 56 S

[56] References Cited

U.S. PATENT DOCUMENTS

| | | | |
|---|---|---|---|
| 2,700,623 | 1/1955 | Hall | 252/12 |
| 3,287,288 | 11/1966 | Reiling | 252/12 |
| 3,996,143 | 12/1976 | Arkin et al. | 252/12 |
| 4,048,370 | 9/1977 | Arkin et al. | 252/12 |
| 4,053,665 | 10/1977 | Arkin et al. | 252/12 |
| 4,134,842 | 1/1979 | Arkin et al. | 252/12 |

FOREIGN PATENT DOCUMENTS

| | | | |
|---|---|---|---|
| 1473235 | 5/1977 | United Kingdom | 252/12 |

*Primary Examiner*—Jacqueline V. Howard
*Attorney, Agent, or Firm*—Bacon & Thomas

[57] ABSTRACT

A lubricant suitable for use in metal forming comprising a copolymer of an unsaturated carboxylic acid and an unsaturated carboxylic acid ester, said copolymer having an acid value of at least 40, polytetrafluoroethylene and a liquid vehicle for the mixture.

8 Claims, No Drawings

LUBRICANT

FIELD OF THE INVENTION

The present invention relates to lubricants and in particular to lubricants for use in metal forming.

BACKGROUND OF THE INVENTION

In forming metals, for example, by pressing or deep drawing, it is necessary to provide some form of lubricant on the surface of the metal to be formed in order to prevent metal to metal contact. It has now been found that a particularly effective lubricant for such purpose comprises, a polymer having free carboxylic groups and polytetrafluoroethylene.

BRIEF DESCRIPTION OF THE INVENTION

Accordingly, the present invention provides a lubricant suitable for use in metal forming comprising a copolymer of an unsaturated carboxylic acid and an unsaturated carboxylic acid ester or a salt of such a copolymer, said copolymer having an acid value of at least 40, preferably from 50 to 150, more preferably from 60 to 140, polytetrafluoroethylene and water and/or an organic vehicle for the mixture.

DETAILED DESCRIPTION OF THE INVENTION

Examples of suitable volatile organic vehicles for the lubricant of the present invention include aliphatic and alicyclic compounds optionally containing halogen, such as ethyl alcohol, methylated spirit, isopropanol, methyl acetate, butyl chloride, trichloroethylene, 1,1,1-trichloroethane, acetone and cyclohexane, as well as aromatic compounds such as benzene, toluene and petroleum naphtha. Desirably water or a mixture of water and an alcohol is used as a vehicle for the lubricant.

The copolymer may be that of a monocarboxylic acid with a carboxylic ester of the formula:

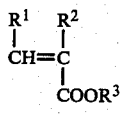

wherein $R^1$ and $R^2$ are each independently hydrogen or methyl and $R^3$ is alkyl containing from 1 to 6 carbon atoms.

The monocarboxylic acid may also have the formula given above wherein $R^1$ and $R^2$ are as previously defined and $R^3$ is hydrogen.

Suitable carboxylic acid include acrylic acid, methacrylic acid and crotonic acid.

Preferably the copolymers are composed of from 60 to 90 mole percent of acid units and from 10 to 40 mole percent of ester units and have an average molecular weight of from 100,000 to 500,000 more preferably from 200,000 to 300,000.

Mixtures of copolymers may be used. Desirably the copolymers are present in the form of a salt, for example the sodium or ammonium salt.

Examples of suitable carboxylated acrylic copolymers are Glascol and Alcolec polymers sold by Allied Colloids Ltd.

Suitably the lubricant according to the present invention may contain from 10 to 30 parts by weight of the copolymers or salt thereof from 1 to 10 parts by weight of the polytetrafluoroethylene and from 50 to 100 parts by weight of water and/or the volatile organic vehicle.

The lubricant of the present invention may additionally comprise, for example, one or more dyes, an inorganic particulate material such as talc which serves to modify the adhesive characteristics of the coating after it has been applied to the metal, a suspending agent such as bentonite or carboxymethyl cellulose and water.

The present invention also provides a method of forming metals which method comprises coating the metal to be formed with one or more layers of a lubricant as described above, removing the vehicle from the coating to leave a dry lubricant film on the surface of the metal and forming the metal.

When required, the coating can be removed from the surface of the formed metal for example by washing with aqueous alkali at ambient temperature.

It is to be understood that the invention also provides a lubricant concentrate comprising a copolymer of an unsaturated carboxylic acid and an unsaturated carboxylic acid ester or a salt of such a copolymer, said copolymer having an acid value of at least 40, and polytetrafluoroethylene which concentrate is intended to be diluted with an appropriate quantity or further quantity of water or a volatile organic vehicle therefore to form the final lubricant. The concentrate may comprise from 10 to 30 parts of the copolymer or salt thereof, from 1 to 10 parts of the polytetrafluoroethylene and from 20 to 45 parts of water and/or the volatile organic vehicle, the parts being by weight.

The following Example is given to illustrate the present invention.

EXAMPLE 2.8 liters of Glascol 616E, 560 grams of polytetrafluoroethylene and 140 milliliters of ammonium hydroxide (d 0.880) were dispersed in 1.7 liters of isopropyl alcohol. Glascol 616E is an aqueous emulsion containing 60% by weight of water and 40% by weight of carboxylated carboxylic acid ester copolymer having an acid value of 130 and an average molecular weight of 250,000. The resulting dispersion was sprayed on to a degreased sheet of steel which was then allowed to dry in air for 5 minutes. The lubricant formed a hard, scuff resistant coating on the steel. After pressing, the steel was washed in water this effectively removing the coating from the sheet. It was noted that the coating material was not transferred onto the die used for the pressing.

COMPARATIVE EXAMPLE

For the purpose of comparison, a lubricant composition was made up as in the Example except that, in place of polytetrafluoroethylene, a corresponding amount of ditetradecyl sebacate was employed.

Stainless steel was deep drawn from circular blanks into cylindrical containers using increasingly small drawing blanks until a limit of drawability was found, indicated by cracks developing during drawing. The maximum drawing ratio found using the comparative lubricant composition was approximately 50%. (Drawing Ratio is measured as 100×(1-diameter of drawing Punch/diameter of blank) Using similar drawing methods but employing the lubricant composition of the invention, a drawing ratio of 58% was obtainable.

I claim:

1. A lubricant suitable for use in metal forming comprising a copolymer of an unsaturated carboxylic acid and an unsaturated carboxylic acid ester, said ester having the formula:

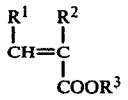

wherein $R^1$ and $R^2$ are each independently hydrogen or methyl and $R^3$ is alkyl containing from 1 to 6 carbon atoms, and said acid having the formula given above wherein $R^1$ and $R^2$ are as previously defined and R is hydrogen, said copolymer having an acid value of at least 40, or a salt of said copolymer, polytetrafluoroethylene and a liquid vehicle for the mixture, which lubricant upon application to a metal surface provides, on removal of the liquid vehicle, a coating in the form of a dry film.

2. A lubricant as claimed in claim 1, wherein the ester is one selected from the group consisting of methyl acrylate, ethyl acrylate, propyl acrylate, butyl acrylate, methyl methacrylate and ethyl crotonate.

3. A lubricant as claimed in claim 1, wherein the acid is one selected from the group consisting of acrylic acid, methacrylic acid and crotonic acid.

4. A lubricant as claimed in claim 1, wherein the copolymer is composed of 60 to 90 mole percent of acid units and from 40 to 10 mole percent of ester units and has an average molecular weight of from 100,000 to 500,000.

5. A lubricant as claimed in claim 1, wherein the copolymer has an acid value of from 50 to 150.

6. A lubricant as claimed in claim 1, which contains from 10 to 30 parts of the copolymer or salt thereof, from 1 to 10 parts of polytetrafluoroethylene and from 50 to 100 parts of vehicle, the parts being parts by weight.

7. A lubricant concentrate comprising from about 10 to 30 parts by weight of a copolymer as defined in claim 1, or a salt of said copolymer, from about 1 to 10 parts by weight of polytetrafluoroethylene and from about 20 to 45 parts by weight of liquid vehicle, which concentrate is intended to be diluted with an appropriate quantity of liquid vehicle to form the final lubricant.

8. A method of forming metals, which method comprises coating the metal to be formed with a lubricant as claimed in claim 1, removing the vehicle from the coating and forming the metal to provide a shaped metal object.

* * * * *